US005214479A

United States Patent [19]

Lindblad et al.

[11] Patent Number: 5,214,479

[45] Date of Patent: May 25, 1993

[54] BTR AIR CLEANER WITH BIASED SHIMS

[75] Inventors: Nero R. Lindblad, Ontario; Bruce E. Thayer, Webster; Gregory J. Mancine, Fairport; Alexander J. Floravanti, Penfield, all of N.Y.

[73] Assignee: Xerox Corporation, Stamford, Conn.

[21] Appl. No.: 937,322

[22] Filed: Aug. 31, 1992

[51] Int. Cl.[5] ..... G03G 21/00

[52] U.S. Cl. ..... 355/271; 355/296; 355/215; 15/379; 15/1.51

[58] Field of Search ..... 355/271, 296, 215; 15/1.51, 347, 349, 363, 379, 381

[56] References Cited

U.S. PATENT DOCUMENTS

| | | | |
|---|---|---|---|
| 1,034,260 | 7/1912 | Lichtenberg | 15/381 X |
| 4,014,065 | 3/1977 | Hudson | 15/421 X |
| 4,026,701 | 5/1977 | Till et al. | 15/345 X |
| 4,093,369 | 6/1978 | Hewitt | 118/652 X |
| 4,121,947 | 10/1978 | Hemphill | 15/301 X |
| 4,348,684 | 9/1982 | Binder | 346/153.1 |
| 4,468,835 | 9/1984 | Rhodes | 15/379 X |
| 4,479,709 | 10/1984 | Syukuri et al. . | |
| 4,530,595 | 7/1985 | Itaya et al. . | |
| 4,647,186 | 3/1987 | Armstrong et al. . | |
| 4,862,224 | 8/1989 | Ku | 355/271 X |
| 4,998,143 | 3/1991 | Kumasaka et al. | 355/271 |
| 5,101,238 | 3/1992 | Creveling et al. | 355/271 |

*Primary Examiner*—R. L. Moses
*Attorney, Agent, or Firm*—Oliff & Berridge

[57] ABSTRACT

Apparatus for cleaning residual toner and paper fiber residue from a biased transfer roll (BTR) in an electrophotographic apparatus using high velocity air and substantially contactless flexible biased conductive shims. The high velocity air flow between the BTR and two thin conductive flex-shims is created by means of a blower that evacuates the air in the cleaner housing vacuum chamber. The high velocity air, in combination with the electrically biased BTR and flex-shims, removes residue from the BTR surface and carries it into the vacuum chamber and deposits the residue in a filter bag. The BTR biased shim cleaner system is low cost, efficient and significantly smaller than current BTR cleaning devices.

11 Claims, 5 Drawing Sheets

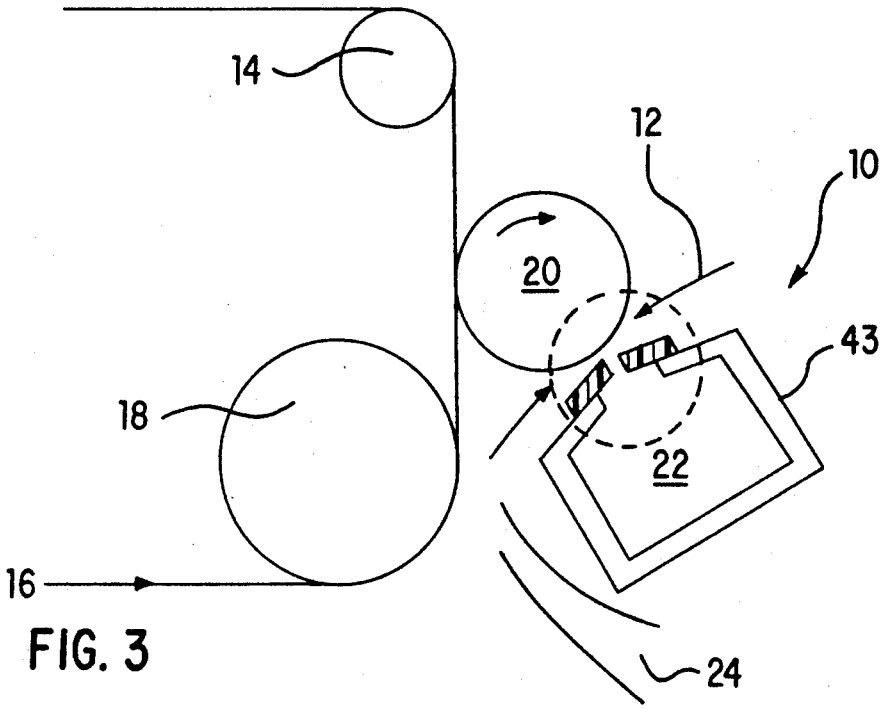
FIG. 3
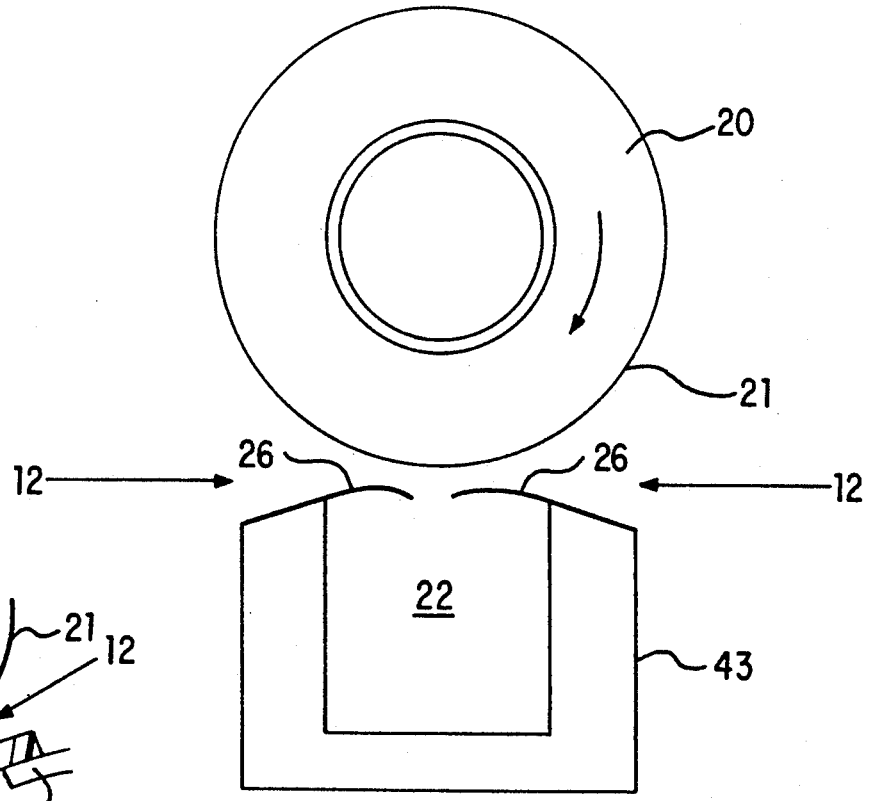
FIG. 4
FIG. 5
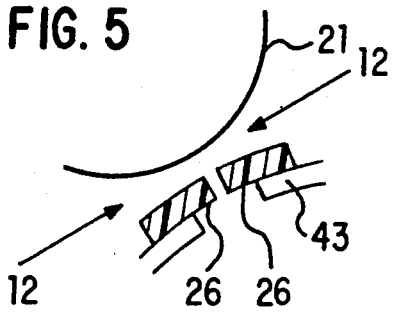

BTR AIR CLEANER WITH BIASED SHIMS

BACKGROUND OF THE INVENTION

1. Field of the Invention

This invention relates to an electrophotographic image forming apparatus, and more particularly to a cleaning device for removing residual toner and debris from the surface of a biased transfer roll (BTR).

2. Description of Related Art

Typical cleaning methods in electrophotographic applications such as xerography, include wiping with a fur brush, a web, a blade and the like, a method using magnetism or a magnetic brush, a method using an air flow and/or a combination of at least several of the above. Cleaning methods employing an air flow are essential for use with the apparatus described herein.

Turning now to FIGS. 1 and 2, cleaning apparatuses known in the art are depicted which include at least some combination of an air flow, a BTR and a brush cleaner which may be electrostatically charged. In FIG. 1, an electrostatic brush cleaner 1 is depicted, including a cleaner housing 43 with upstream and downstream air inlets 40. To be effective, electrostatic brush cleaners must balance the air flows from the two sides of the housing 43. This is typically done by controlling the cleaner housing 43 spacing to the photoreceptor 16, the spacing between the brush 41 and the cleaner housing inner wall 35 and/or by adding interferences 39 between the brush 41 and the cleaner housing inner wall 35 near an air inlet 40 to create a pressure situation which will affect the air flow (air flow direction indicated at arrow 11). Additionally, positively and negatively charged detoning rolls 20*a*, 20*b* are used to assist the air flow in removing particles from the electrostatic brush 41. A flicker bar 37 is provided to help knock the toner particles free of the electrostatic brush 41 fibers.

In FIG. 2, a BTR cleaner 2 is depicted, using a rotating brush 3 in combination with an air system. The brush 3 removes toner from the BTR 20 and the air flow detones the brush fibers, with air flow direction indicated at arrow 11.

The main disadvantages of the prior art devices discussed above include large size, insufficient component life, BTR surface abrasion and high unit manufacturing costs.

Cleaning apparatuses employing an electrical bias to clean residual toner from an electrostatically charged surface in an electrophotographic device are also known.

U.S. Pat. No. 4,647,186, to Armstrong et al., discloses an apparatus for scavenging undesired charge particles from the surface of a recording element. The apparatus consists of a grid structure comprising a plurality of parallel, non-magnetic, electrically conductive wires. The plate is connected to an AC/DC power supply whose polarity is opposite to that of the charge particles to be scavenged. The AC grid bias functions to alternately attract the charged particles from the recording element and towards the grid, and then repel such particles from the grid itself. The grid, composed of a plurality of wires allows the scavenged particles to pass (or be pulled) through the grid by the magnetic influences of a magnetic brush applicator positioned directly beneath the grid.

U.S. Pat. No. 4,530,595, to Itaya et al., discloses a method and apparatus for cleaning the surface of an electrostatic image holder, where a DC voltage and/or an AC voltage whose polarity is opposite to that of the residual developer on the electrostatic image holder is impressed between an electrostatic image holder and a film member, one side of which is electrically conductive and the other side is insulated. The insulated surface of the film member is held close to the image holder and a voltage is impressed between an electrode and an electrostatic image holder. A removing means is used to remove the developer adhered on the insulating surface of the film member.

U.S. Pat. No. 4,479,709, to Syukuri et al., discloses a cleaning method to remove toner attached to an image retaining member of an electrophotographic copying machine, without damaging the surface of the image retaining member. An alternating electric field is applied to the surface to be charged. When applied, the toner on the photosensitive receptor drum moves to the roller and adheres thereto. The toner on the surface roller is scraped off by a blade and is collected in a recovery box.

It is important, for purposes of this invention, to clearly describe the BTR function in the electrophotographic apparatus. Paper, to which the image will be transferred, is fed into a nip formed by the BTR and the photoreceptor belt. The BTR is rotated at the same speed as the photoreceptor so that no relative motion between the paper and the untransferred toner image occurs. The BTR consists of an aluminum core with a slightly conductive urethane rubber coating. A high bias is applied to the core which creates an electric field at the paper which causes the charged toner particles to transfer from the photoreceptor surface to the paper. The advantage of using a BTR over corona transfer is that the pressure created in the BTR nip flattens out any ripples, etc., in the paper which create gaps between the paper and the photoreceptor. These gaps decrease the strength of the field needed to transfer toner to the paper and cause deletions in the resulting copies. The same gaps can be caused by large particles, such as carrier beads or toner agglomerates from the developer housing. These create "tent" deletions which appear as white circles around the large particles. BTRs can improve the appearance of copies by greatly decreasing the diameter of the "tent" deletions.

Consequently, there is a need to clean the BTR surface because paper fibers from the backside of the copy can be attracted to the biased roll and toner which occurs on the photoreceptor between the copy regions will transfer to the roll. This toner consists of low level "background" toner, toner developed as a control patch used in maintaining the proper toner concentration and development field in the developer housing, and toner which accumulates on the lapped seam of the belt. If these materials are not cleaned from the BTR surface, they may retransfer to the back of copy sheets, appearing as spots and smudges, and if duplexed copies are being run, the spots and smudges will appear on both sides of the copies.

During development of the present invention, a device using high velocity air to remove toner and other residue from the surface of a BTR and to carry it into an evacuated chamber and then to a toner filter bag was tried. The high velocity tangential air flow was generated between two thin flexible shims and the surface of the BTR by means of a blower that evacuated the air in the cleaner housing and caused the shims to flutter.

Testing revealed that, with high velocity tangential air and thin, flexible plastic shims alone, however, the cleaning results were marginal. Further testing showed that by attaching a short pile disturber fabric to the plastic shims, cleaning could be markedly improved. In this mode, the fabric material rides lightly on the surface of the roll and disturbs the toner allowing the air flowing through the fibers to move the toner into the chamber.

Several concerns exist with this arrangement, however, Abrasion of the BTR surface by the fabric may reduce roll life and the fabric material may wear because it is contacting the BTR surface. These problems may be overcome by selecting BTR and fabric materials that are not sensitive to wear, although, this option would likely be cost prohibitive in most uses currently envisioned.

Finally, the performance of the BTR air cleaner with biased shims has been predicted through testing over a range of BTR and cleaner shim biases. As known in the art, the cleaning performance necessarily depends on the charge of toner entering the transfer nip, the mass density of toner input and the efficiencies of pressure transfer and cleaning of toner by air flow alone. In particular, the biased shim BTR cleaner described herein has been shown to work over a reasonable range of currents and biases. However, additional operating latitude could be gained by increasing the cleaner air flow from the 9.5 cubic feet per minute used herein.

SUMMARY OF THE INVENTION

It is thus an object of the invention to obviate the foregoing drawbacks of the prior art by providing an improved BTR air cleaner with electrically biased shims.

Another object of the invention is to combine high velocity tangential air flow with a vacuum system and substantially contactless flexible conductive shims which are provided an electrical current which creates an electric field relative to the BTR, thereby assisting in the detachment of toner and other residue from the BTR surface.

It is still another object of the invention to provide a BTR air cleaner with biased shims that is significantly smaller (e.g., 60% smaller than the cleaner in FIG. 2), inexpensive to manufacture with substantially increased component life (e.g., roughly three times greater than the cleaner in FIG. 2) and low BTR surface abrasion, and is cost effective to operate. Power savings alone could reduce costs by one third (again, relative to the cleaner in FIG. 2).

These and other objects and advantages are obtained by the inventive BTR air cleaner with biased shims. The apparatus includes a cleaner housing mounted adjacent to the BTR including two flexible conductive shims mounted on opposite sides of a vacuum chamber air inlet and stretched along the air inlet without touching each other. As will be seen shortly, the shims flutter during operation as a result of the air flow and lightly contact the BTR surface, but remain substantially contactless due to the air flow. A means for creating and controlling air flow rate through the air inlet, and a means for applying DC electrical current to and between the shims and the BTR are also provided. In a preferred embodiment, the conductive shims are made of a conductive synthetic resin or plastic and, for a transfer current of $-50\ \mu A$, a bias range of $-2.1$ kv to $-3.3$ kv above the BTR bias applied to the shims results in good BTR surface cleaning for all environments, even under stressed conditions. In another preferred embodiment, for a transfer current of $-75\ \mu A$, a bias range of $-2.6$ kv to $-3.4$ kv above the BTR bias applied to the shims results in equally good BTR surface cleaning for all environments, even under stressed conditions. Alternatively, various other DC voltage options are possible. Additionally, AC bias voltage may also be possible, for example, bias voltages of $-3$ kv and $-5$ kv may be applied to the BTR and shims respectively, with a DC rider signal of $\pm 500$ volts riding on the $-5$ kv shim voltage. In still another embodiment, conductive disturber fabric is fixedly attached to the shims which will lightly contact the BTR surface to disturb the toner and assist the electrostatic and air current means removal of the residual toner.

As the air passes over and between the BTR and shims, the shims will tend to flutter, to at least some extent, dependent upon the air flow. Therefore, the shims will lightly contact the BTR surface, thereby further enhancing BTR surface cleaning, but remain substantially contactless due to the air flow.

Other objects, advantages, and salient features of the invention will become apparent from the detailed description, which taken in conjunction with the annexed drawings, discloses preferred embodiments of the invention.

BRIEF DESCRIPTION OF THE DRAWINGS

Referring now to the drawings which form part of this original disclosure:

FIG. 3 is a schematic plan view depicting the invention;

FIG. 4 is a schematic plan view depicting the BTR and biased seal arrangement in operation (i.e., fluttering);

FIG. 5 is an enlarged schematic plan view of the circled area of FIG. 3 showing the shim in operation (i.e., fluttering);

DETAILED DESCRIPTION OF THE PREFERRED EMBODIMENTS

Figure 1:
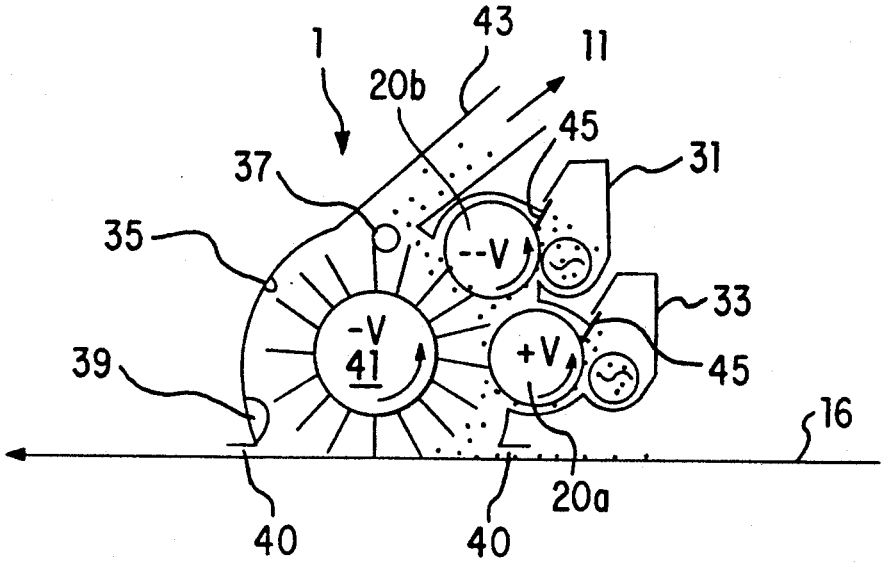
FIG. 1 PRIOR ART
FIGS. 1 and 2 are schematic plan views of prior art cleaning apparatuses.
Figure 2:
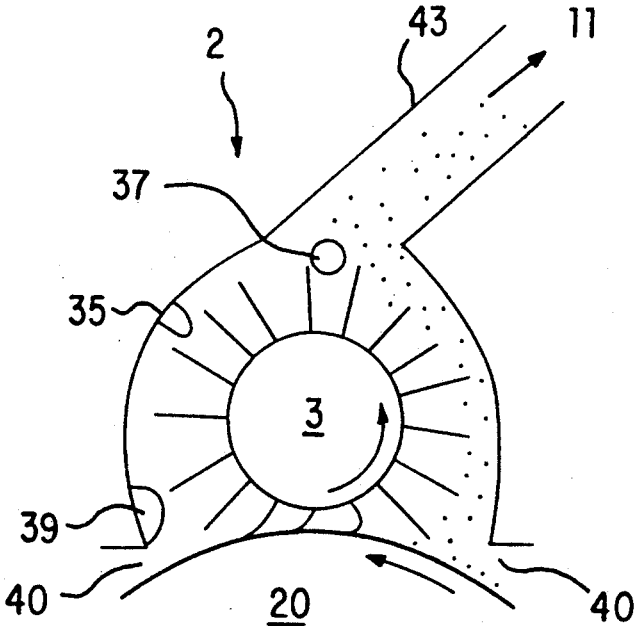
FIG. 2 PRIOR ART

The apparatus for an improved cleaning means including a BTR air cleaner with biased shims will be described in combination with a particular copier or xerographic device that uses a BTR. However, the apparatus may be used with any printing apparatus that includes a toner retentive imaging surface and a cleaning method that includes an air current.

For a general understanding of the features of the present invention, reference is made to the drawings. In the drawings, like reference numerals have been used throughout to designate identical elements.

Turning now to FIGS. 3–8, a first embodiment of the invention is depicted. Shown is an apparatus for cleaning toner and paper fiber residue (see FIG. 3) from the surface 21 of a BTR 20 in an electrophotographic apparatus using high velocity air and substantially contactless, flexible, electrically biased conductive shims 26. A high velocity, preferably 9.5 cubic feet per minute, air flow 12 between the BTR 20 and two thin conductive flex-shims 26 is created and controlled by means of a blower 53 that evacuates the air in the cleaner housing vacuum chamber 22. The high velocity air 12, in combination with the electrically biased flex- shims 26, removes the residue from the BTR surface 21 and carries it into and through the vacuum chamber 22 and deposits the residue in a filter bag 51 (see FIG. 6). The BTR biased shim cleaner 10 system as described herein, is low cost, smaller and will have longer component life with significantly less BTR surface abrasion than prior devices.

In FIG. 3, portions of an electrophotographic apparatus are shown, including the image forming surface of a moving photoreceptor 16 which is in contact with an electrically biased BTR 20. Also shown is a belt drive roll 18, stripper roll 14, and paper guide 24.

FIG. 4 shows the structural relationship between the BTR surface 21, the flexible conductive shims 26 and the vacuum chamber 22 of the cleaner housing 43. As air flows between the flexible conductive shims 26 and the BTR surface 21, the shims 26 will tend to flutter, to at least some extent, dependent upon air flow 12. Therefore, the shims 26 will disturb the toner and paper fiber residue, yet remain substantially contactless with respect to the BTR surface 21, to further enhance cleaning.

In FIG. 5, an enlarged view of a portion of the circled area in FIG. 3 is shown in order to more clearly show the conductive flex-shims 26 during flutter.

Figure 6:
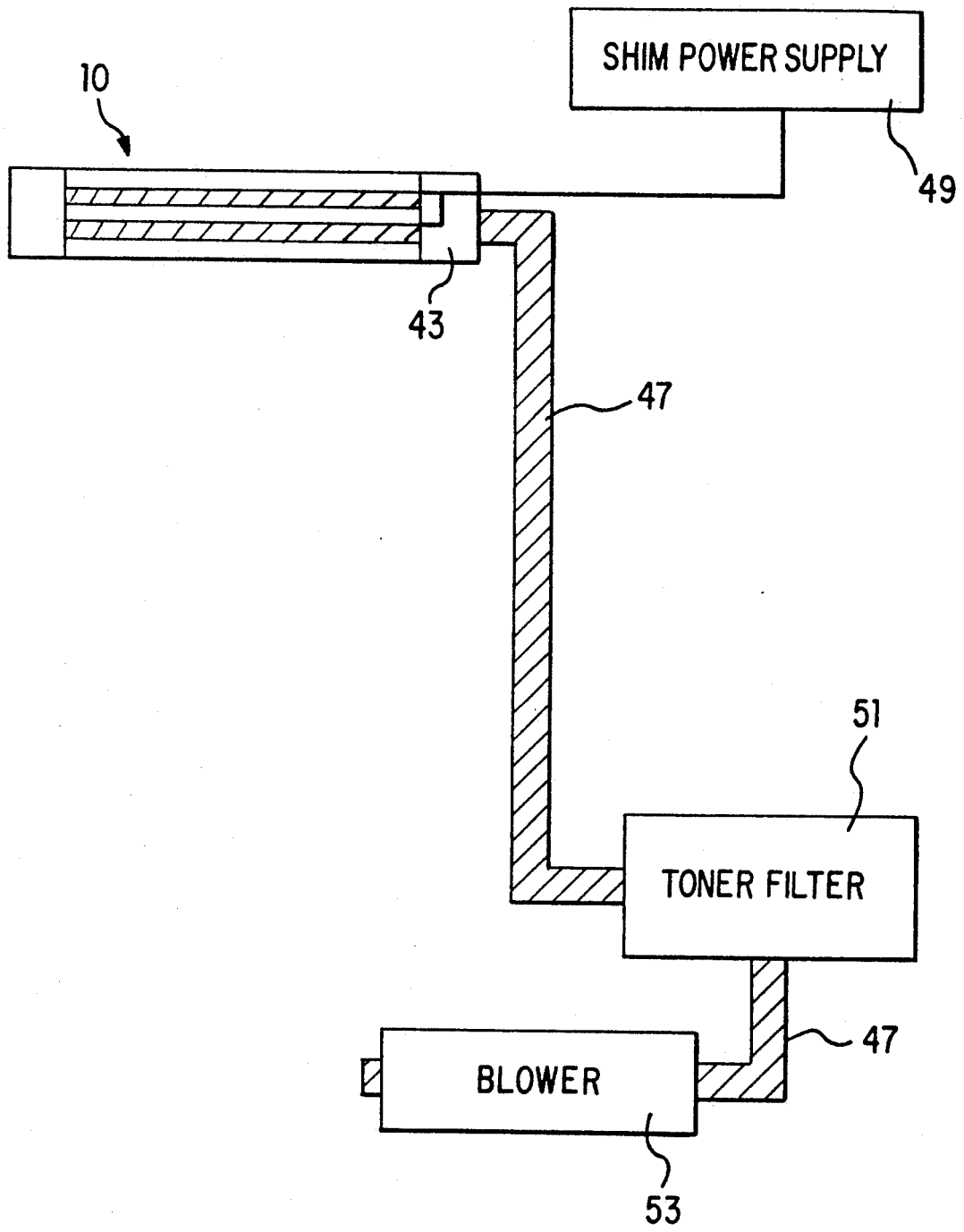
FIG. 6 is a schematic plan view depicting the elements of the invention.

FIG. 6 shows the BTR biased shim cleaner 10 system arrangement (BTR and BTR power supply not shown), wherein the BTR biased shim cleaner 10 is connected to a shim power supply 49 and the cleaner housing 43 is connected to a blower 53 by means of an air hose 47, the evacuated air and toner passing through a toner filter 51, where scavenged toner is collected.

Figure 7:
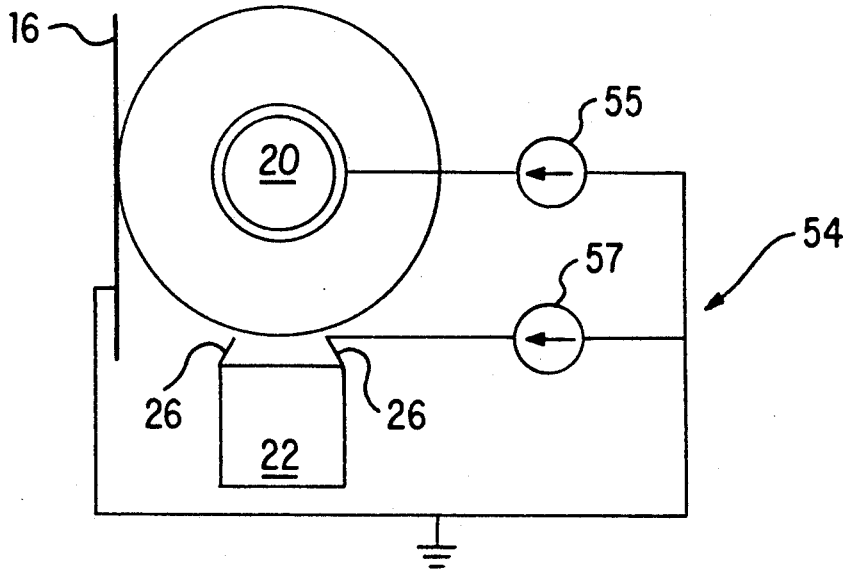
FIGS. 7 and 8 are schematic views depicting electrical relationships pertinent to the invention.
Figure 8:
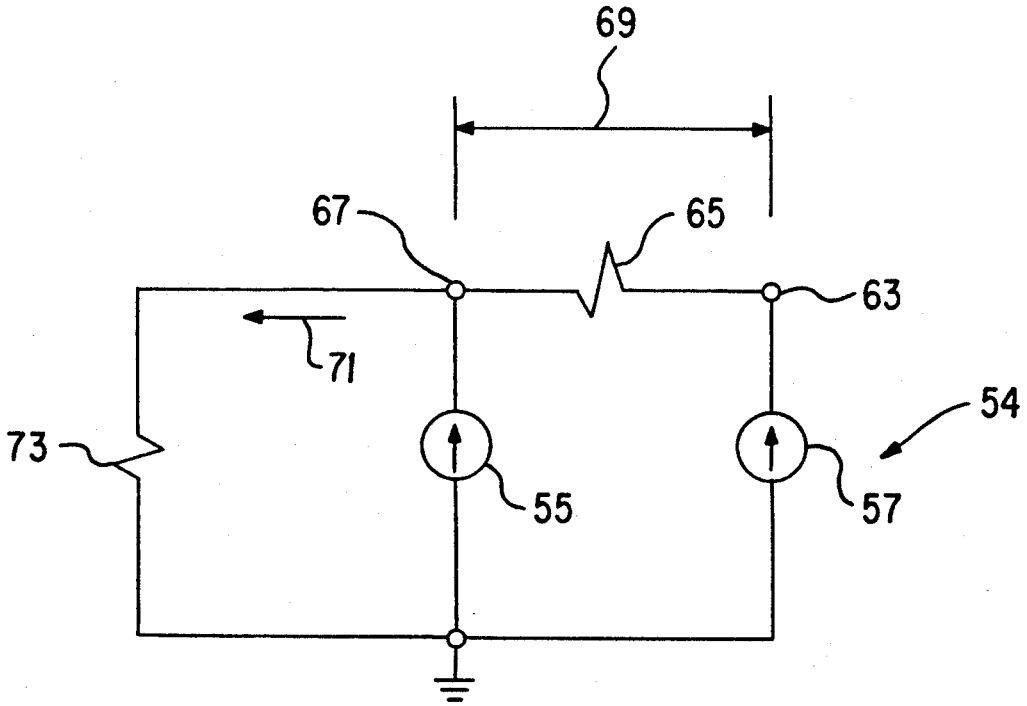

FIGS. 7 and 8 depict the BTR 20 and shim 26 power supplies and bias relationships. In particular, FIG. 7 shows the BTR and biased shim circuit 54, wherein BTR current 55 and shim current 57 are indicated. In FIG. 8, the relationship between BTR and shim current 55, 57 is shown, wherein transfer current 71 equals BTR current 55 plus shim current 57. In the circuit diagram 54, transfer current 71 is a function of BTR current 55 and shim current 57 which provides BTR voltage 67 and shim voltage 63 respectively. Further, the difference in voltage 69 (i.e. V shims) is a function of the resistance 65 (between shims 26 and BTR core 20), while BTR resistance is indicated at 73.

As discussed above, an electrical bias is applied between the shims 26 and the BTR 20 which helps to detach the residue from the BTR surface 21. This is a substantially contactless cleaner because the shims only intermittently touch the BTR surface 21 due to flutter caused by the air flow between the flexible conductive shims 26 and the surface of the BTR 21. Results have shown that for a transfer current of 50 $\mu$A, a DC bias voltage range from $-2.1$ kv to $-3.3$ kv above the BTR bias on the shims 26 produces good cleaning for all environments even under stressed conditions. Additionally, for a transfer current of 75 $\mu$A, a DC bias voltage range from $-2.6$ kv to $-3.4$ kv above the BTR bias on the shims 26 also produces good cleaning for all environments under stressed conditions. However, various other DC voltage combinations are possible. Additionally, AC bias voltages may also be possible, for example, bias voltages of $-3$ kv and $-5$ kv may be applied to the BTR and shims respectively, with a DC rider signal of $\pm 500$ volts riding on the $-5$ kv shim voltage.

In another embodiment (see FIGS. 9 and 10), the use of conductive disturber fabric 26*a* is shown. This embodiment is useful with electrophotographic apparatuses having particularly stubborn or large toner cleaning requirements.

Figure 9:
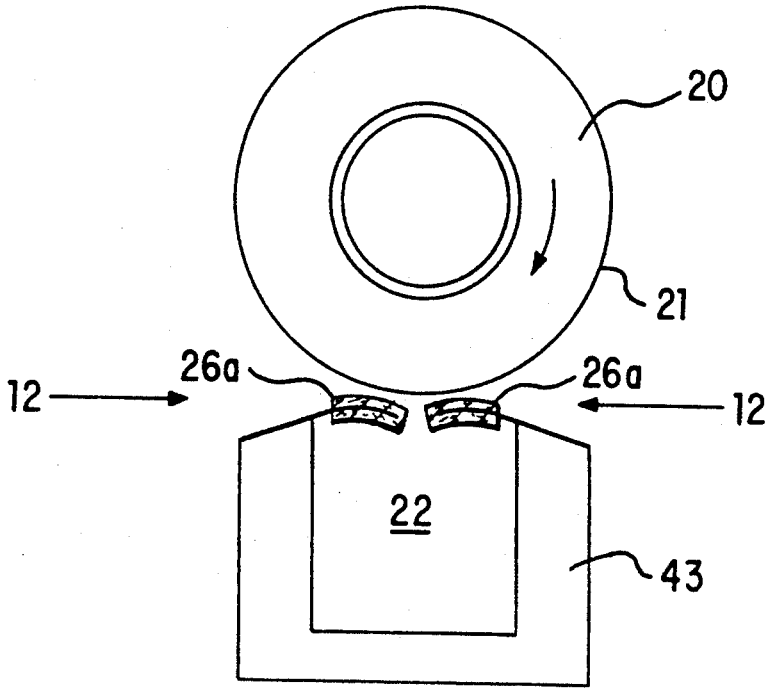
FIGS. 9 and 10 are schematic plan views similar to FIGS. 4 and 5 depicting an alternative embodiment.
Figure 10:
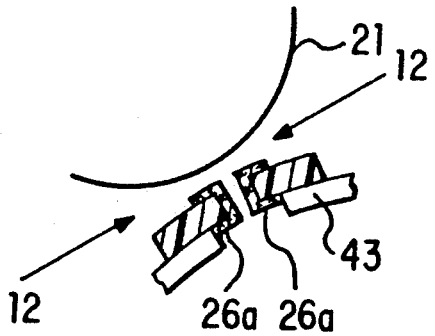

The apparatus shown in FIGS. 9 and 10 would operate in the same basic manner as described with respect to the first embodiment. However, the conductive disturber fabric 26*a* would lightly contact the BTR surface 21 to disturb the toner and assist the electrostatic and air flow means of removing the residual toner. Abrasion of the BTR surface 21 and wear of the fabric material 26*a* is less of a concern in this embodiment since contact is very light, again due to the air flow 12. However, BTR and fabric materials not sensitive to wear may be selected if high volume uses are envisioned.

While the present invention has been described in connection with the preferred embodiments, it will be understood that it is not intended to limit the invention to these embodiments. On the contrary, it is intended to cover all alternatives, modifications and equivalents as may be included within the spirit and scope of the invention as defined by the appended claims.

What is claimed is:

1. A cleaning apparatus, for an electrophotographic apparatus, for removing residual toner particles and paper fibers from the surface of a rotating biased transfer roll, said cleaning apparatus employing an air current, comprising:

a cleaner housing mounted adjacent to said biased transfer roll, said housing further comprising a vacuum chamber fixedly arranged adjacent said biased transfer roll with two flexible conductive shims fixedly mounted on opposite sides of an air inlet of said vacuum chamber, said shims stretched along said air inlet without touching each other;

a means for creating and controlling air flow across and through said air inlet; and a means for applying electrical bias voltage to and between said shims and said biased transfer roll.

2. The apparatus of claim 1, wherein said air flow creating and controlling means comprises a blower connected to said vacuum chamber by means of an air hose.

3. The apparatus of claim 2, further comprising a toner filter disposed between said vacuum chamber and said blower in communication therewith, such that removed toner particles are deposited in said toner filter.

4. The apparatus of claim 1, wherein said residual toner and paper fibers are removed from said biased transfer roll by combined action of said electrical bias between said shims and said biased transfer roll, said air flow between said shims and said biased transfer roll causing said shims to flutter and acting to carry said removed toner and paper fibers through said air inlet into said vacuum chamber to a toner filter where said removed toner and paper fibers are deposited.

5. The apparatus of claim 1, wherein, for a particular transfer current, a first DC current is applied to said biased transfer roll and a second DC current is applied to said shims creating an electric field between said biased transfer roll and said shims.

6. The apparatus of claim 5, wherein said transfer current is $-50$ $\mu$A, said first DC current is $-15$ $\mu$A and said second DC current is $-35\ \mu A$ creating an electric field of $-2.5$ kv.

7. The apparatus of claim 5, wherein said transfer current is $-75\ \mu A$, said first DC current is $-30\ \mu A$ and said second DC current is $-45\ \mu A$ creating an electric field of $-3$ kv.

8. The apparatus of claim 1, wherein an air flow rate between 5.5 cubic feet per minute and 13.5 cubic feet per minute is created between said shims and said biased transfer roll.

9. The apparatus of claim 1, wherein an air flow rate of 9.5 cubic feet per minute is created between said shims and said biased transfer roll.

10. The apparatus of claim 1, wherein said shims are made from a conductive synthetic resin material.

11. The apparatus of claim 1, wherein said shims include a fixedly attached conductive disturber fabric.

* * * * *